US006800000B2

(12) United States Patent
Pettersen

(10) Patent No.: US 6,800,000 B2
(45) Date of Patent: Oct. 5, 2004

(54) CONNECTING PIECE OF ELECTRICALLY CONDUCTING MATERIAL, PREFERABLY A CABLE SHOE, TOGETHER WITH A METHOD FOR ITS IMPLEMENTATION

(75) Inventor: Ola Pettersen, Lund (SE)

(73) Assignee: Safetrack Baavhammer AB, Staffanstorp (SE)

( * ) Notice: Subject to any disclaimer, the term of this patent is extended or adjusted under 35 U.S.C. 154(b) by 0 days.

(21) Appl. No.: 10/144,794

(22) Filed: May 15, 2002

(65) Prior Publication Data

US 2002/0173207 A1 Nov. 21, 2002

(30) Foreign Application Priority Data

May 15, 2001 (SE) ..... 0101689

(51) Int. Cl.[7] ..... H01R 13/02

(52) U.S. Cl. ..... 439/886; 439/524

(58) Field of Search ..... 439/874, 886, 439/524, 931, 86, 87, 90

(56) References Cited

U.S. PATENT DOCUMENTS 3,787,795 A * 1/1974 Thompson et al. ..... 439/99
4,323,293 A * 4/1982 DeRouen et al. ..... 439/76.1
4,530,563 A * 7/1985 Brzezinski ..... 439/874
5,739,837 A * 4/1998 Nagahata et al. ..... 347/200

* cited by examiner

*Primary Examiner*—Tho D. Ta
*Assistant Examiner*—James R. Harvey
(74) *Attorney, Agent, or Firm*—Jacobson Holman PLLC

(57) ABSTRACT

A connecting piece of electrically conducting material with a pressed-on brazing clip mounted on a compact plate with a flux material, and a method for producing such a connecting piece.

6 Claims, 20 Drawing Sheets

CONNECTING PIECE OF ELECTRICALLY CONDUCTING MATERIAL, PREFERABLY A CABLE SHOE, TOGETHER WITH A METHOD FOR ITS IMPLEMENTATION

BACKGROUND OF THE INVENTION

1. Field of the Invention

The present invention relates to a method for producing a new type of connecting piece of metal or another electrically conducting material, preferably a cable shoe, that is to be joined to another object of metal or another electrically conducting material by means of brazing and in which heat is produced by an electric arc. The shape and construction of the electrically conducting connecting piece prevent the formation of structural changes (martensite formation) underneath the brazed joint. The invention also relates to such a connecting piece, preferably a cable shoe, of metal or another electrically conducting material.

2. Description of Related Art

Developments in railway traffic involve ever higher speeds and heavier axle loads. This in turn places increasing demands on the strength of railway track and its ability to withstand wear and accordingly rails are manufactured from higher-alloyed steel in order to meet these more stringent requirements. The material from which rails are manufactured is sensitive to thermal influences that can cause structural changes known as martensite formation (hardening effect).

Martensite formation may lead to crack formation in the rail material and due to the higher loads the rail may fracture, with catastrophic consequences for railway traffic. Consequently it is very important to braze signal and other wiring and cabling firmly to the rail by using a method that does not cause martensite formation in the rail.

Up to now it has only been possible to minimise martensite formation or structural changes by means of a pin brazing method, which is described in Swedish patent 9003708-6 (469 319). Hitherto it has not been possible by any pin brazing method to completely eliminate martensite formation in electrical contact connections that are intended to join two or more objects by means of an electrical connection.

The most serious problem in current pin brazing methods employed on railway track is the large amount of heat that is produced underneath the brazing joint, which is caused by the electric arc that is generated in the brazing process and produces a deleterious structural change or martensite formation. The problem is to a large extent due to the pin brazing method that is currently employed. The flux material and silver solder that are required in the brazing are supplied via a brazing pin that is secured in the brazing gun and that at the same time forms an electrode.

In order to produce a connection between metal surfaces on rails/pipework and cable shoes, the current procedure is to provide a cable shoe with an opening so that flux material and brazing material can pass from the brazing pin through the cable shoe and then firmly braze the cable shoe to the flat metal surface. At the start of the brazing process the electric arc acts directly on the rail and produces locally a very high temperature which is then transmitted indirectly via the braze melt and generates high temperatures directly in the rail, which have a deleterious effect on the latter. There is also the risk of an alloying of electrode material in the brazing material when using conventional pin brazing systems, which has adverse effects on both the brazing and workpiece. The final stage in the currently employed pin brazing involves pressing the brazing pin downwardly into the brazing and then breaking off the pin, which has a negative effect on the brazed joint itself.

Furthermore, a disadvantage of current brazing processes is that both the flux material and brazing material are used in order to secure the electrically conducting connecting piece, preferably a cable shoe. Since the brazing process takes place over a short period, a large amount of heat is required which is transmitted from the electric arc via the brazing material through the cable shoe to the workpiece or rail. The problem has been that a satisfactorily secure brazing has to be produced at the same time without causing any structural changes underneath the brazing joint.

At the present time in France, Italy, Switzerland, Spain and Germany it is prohibited to use pin brazing on railway track on account of martensite formation.

Certain other countries where pin brazing on railway track is currently permitted are in the process of changing their requirements and consequently existing pin brazing methods will no longer be allowed to be used in the future.

BRIEF SUMMARY OF THE DESCRIPTION

The present invention relates to a new type of electrically conducting connecting piece of metal or another electrically conducting material, preferably a cable shoe, which involves a new method of temperature-controlled brazing in which the problem of martensite formation that affects other methods is solved.

The invention also relates to a method for implementing this new type of connecting piece of metal or another electrically conducting material, preferably a cable shoe.

An object of the present invention is to provide a connecting piece of electrically conducting material, preferably a cable shoe, that has a continuous compact flat end of electrically conducting material on which the electric arc acts during the brazing process in such a way that the arc does not come into direct contact with the workpiece, for example a rail, during the brazing process, and that the connecting piece together with the compact plate forms part of the temperature-controlled brazing process in which a brazing is obtained that is completely free of martensite underneath the brazed joint.

Another object of the present invention is to be able during the fabrication to press a brazing material in the form of a clip on the connecting piece and also place a flux material between the connecting piece and the brazing clip during fabrication. This saves a workstage and solves the problem of brazing per se in the workplace.

Moreover, an advantage is that brazing material does not need to be supplied from other units to the brazing joint per se in order firmly to braze the connecting piece, nor do the surfaces between the connecting piece and brazing material need to be cleaned in a separate operation.

A significant advantage of pressing a brazing material clip firmly on the underneath side during the fabrication of the connecting piece is that a uniform thickness is obtained on the brazing clip. This is shaped so that it is larger than the connecting piece per se, preferably a cable shoe, and projects beyond the edges of the latter. This forms a more solid and more complete assembly of the cable shoe and workpiece, and also prevents water penetrating by means of capillary forces between the cable shoe and the underlying workpiece, and in addition prevents corrosion. Penetrating water can have a deleterious effect on the mechanical strength of the brazed joint. In addition this can impair the electrical properties of the connection. Since the brazing clip is larger than the cable shoe, a larger joint surface is formed, which in turn produces a smaller electrical contact resistance.

In railway signal and cathode protection systems that operate at low voltages and currents, it is particularly important to have a low overall contact resistance in the brazed joints in order to prevent interferences in the system. With large currents and voltages, a high contact resistance leads to the evolution of heat in the brazed joint, which may damage and/or melt the latter. Since the connection also has to withstand high return currents in the railway operations system it is important to have a low contact resistance in the brazed joint.

For a similar reason it is also important that the contact resistance is low in protective grounding.

A further advantage of this new brazing process is that the rail does not need to be grounded during the brazing. In the brazing process the electrode serves as one pole of the arc and the other pole is formed by the electrically conducting connecting piece, for example a cable shoe. In this case the electrically conducting connecting piece forms the negative pole, conventionally called the connection in grounding terminology. In the present invention the electrode may form the positive pole or negative pole, or alternately positive/negative pole. It is an advantage not to use the rail as a pole since secondary arcs may be formed between the cable shoe and rail, which may have a negative effect on the rail in the form of martensite formation. Moreover, by excluding the rail from the closed electrical circuit the cause of possible interfering signals in the rail and apparatus connected thereto is eliminated. The use of the cable shoe as one pole also eliminates a workstage and in certain situations grounding equipment associated with the brazing. The cable shoe can be connected to the electrical circuit via the guard ring in the brazing gun or via the cable connected to the cable shoe.

Another object of the present invention is that carbon powder from the carbon electrode is released during the brazing process and is deposited on the upper surface of the electrically conducting connecting piece, for example a cable shoe, and prevents the formation of a cavity in the cable shoe during the brazing procedure. In addition the electric arc is established between two carbon poles, which has a stabilising effect on the arc and counteracts the tendency of the current to fall over time. Furthermore the carbon has thermally insulating properties and exerts a temperature distributing function. The carbon powder from the carbon electrode consequently also acts as a buffer material, thereby preventing too high a temperature in, for example, the rail during the brazing process.

These and other objects are achieved by the method of the present invention for producing a new type of connecting piece of electrically conducting material, preferably a cable shoe, that is to be joined to another object of electrically conducting material by means of a temperature-controlled brazing process free from structural changes and martensite formation, characterised in that a tube of electrically conducting material and a brazing material suitable for hard brazing with an intermediate flux material suitable for soft brazing are pressed between an upper part of a tool and a lower part of a tool so as to form a connecting piece with a brazing clip pressed thereon and an intermediately located flux material, and in which the brazing clip consists of an upper part with two holes, a lower part and a rear part with two holes and the brazing clip is larger than a compact plate in one part of the connecting piece, and that the brazing clip is wholly of uniform thickness and that a bevelled section separates the lower part of the brazing clip from its rear part.

BRIEF DESCRIPTION OF THE DRAWINGS

The present invention will now be described in more detail hereinafter with reference to the accompanying drawings that show various embodiments of the invention, in which.

DETAILED DESCRIPTION OF THE PREFERRED EMBODIMENTS

Figure 1:
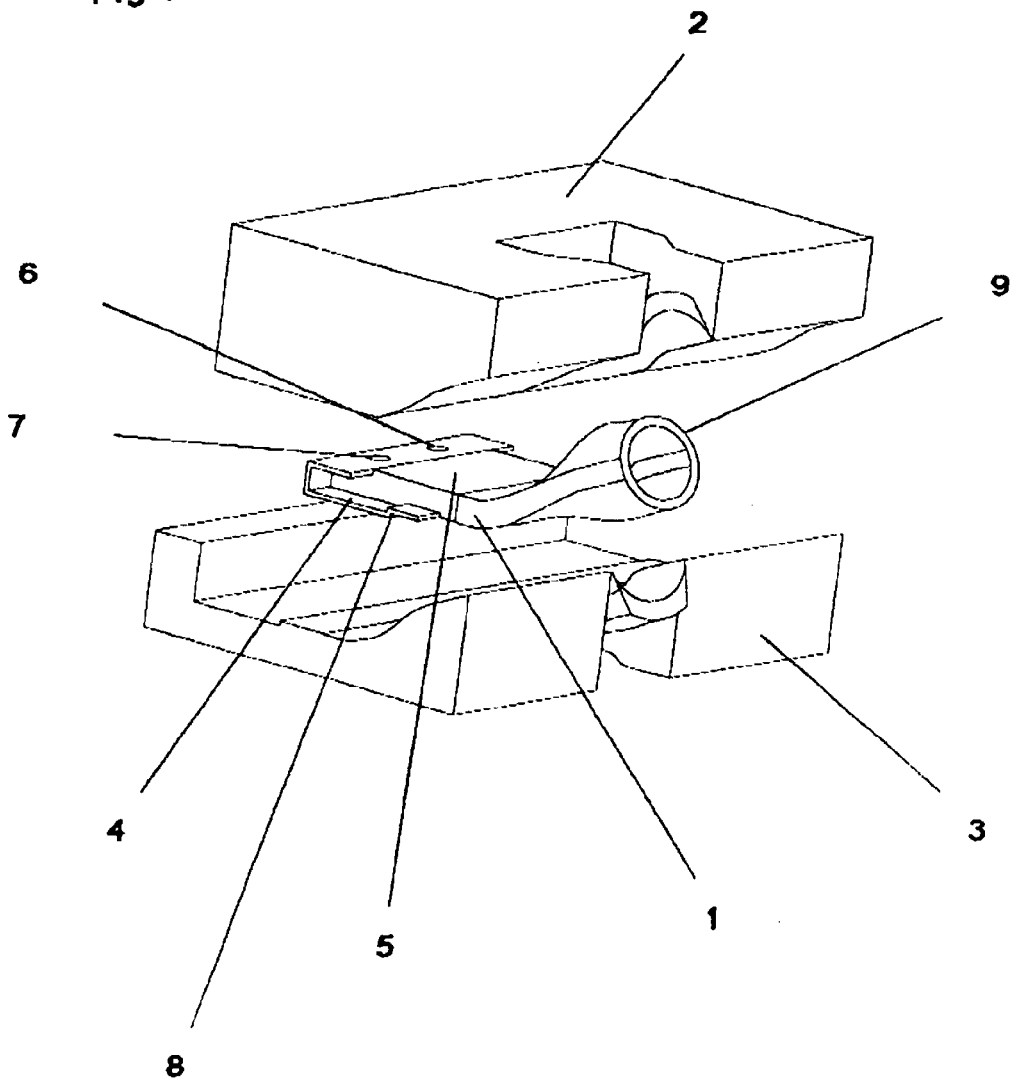
FIG. 1 shows a fabrication tool for producing a connecting piece of electrically conducting material.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 shows a fabrication tool for producing a connecting piece 1 of electrically conducting material around which is placed a brazing material of uniform thickness, whereby when the upper part 2 (male part) of the tool is pressed against the lower part 3 (female part) of the tool, a pressed-on brazing clip 4 is formed. An electrically conducting material in the form of a tube 9 is pressed between the upper part 2 and lower part 3 of the tool and forms a compact plate 5 of electrically conducting material against which the brazing clip 4, with flux material spread on at least one side, is pressed. The figure also shows that the brazing clip 4 is larger than the compact plate 5 and consequently the brazing clip 4 projects out around the compact plate 5. It can also be seen from the figure that the upper part of the brazing clip 4 is pressed down into the compact plate 5 and two holes 6 and 7, through which the underlying electrically conducting material passes, firmly secure the brazing clip 4 and preserve the flux material that is now contained between the brazing clip 4 and the compact plate 5. As regards the lower part of the brazing clip 4, only the part that is separated from the bevelled surface 8 penetrates the material of the connecting piece 1.

Figure 2:
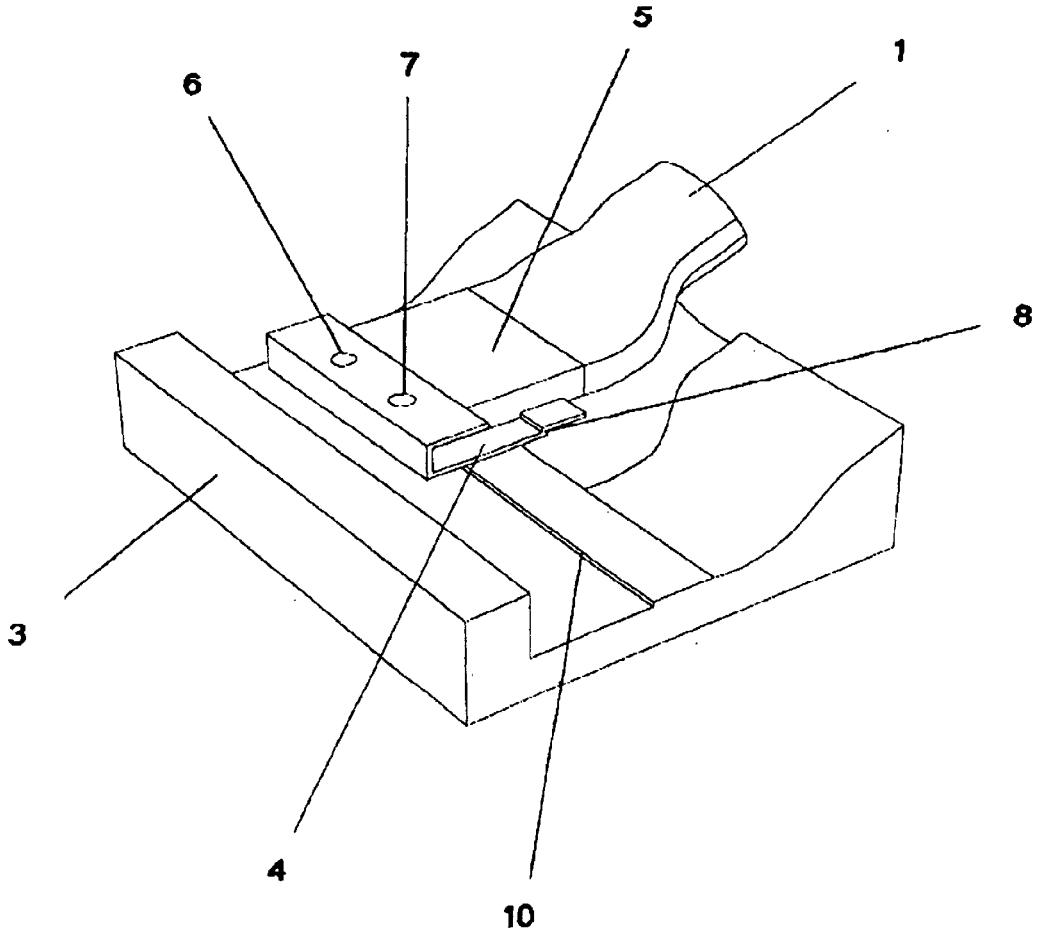
FIG. 2 shows the underneath part of the fabrication tool of FIG. 1.

FIG. 2 shows the lower part 3 of the fabrication tool for producing a connecting piece 1 of electrically conducting material around which is placed a brazing material of uniform thickness, which when pressed together form a pressed-on brazing clip 4. An electrically conducting material in the form of a tube when pressed together forms a compact plate 5 of electrically conducting material against which the brazing clip 4, coated on at least one side with flux material, is pressed. The figure also shows that the brazing clip 4 is larger than the compact plate 5 and accordingly the brazing clip 4 projects out around the compact plate 5. It can also be seen from the figure that the upper part of the brazing clip 4 is pressed down into the compact plate 5 and two holes 6 and 7, through which the underlying electrically conducting material passes, firmly secure the brazing clip 4 and preserve the flux material that is now contained between the brazing clip 4 and the compact plate 5. As regards the lower part of the brazing clip 4, only the part that is separated from the bevelled surface 8 penetrates the material of the connecting piece 1.

Figure 3:
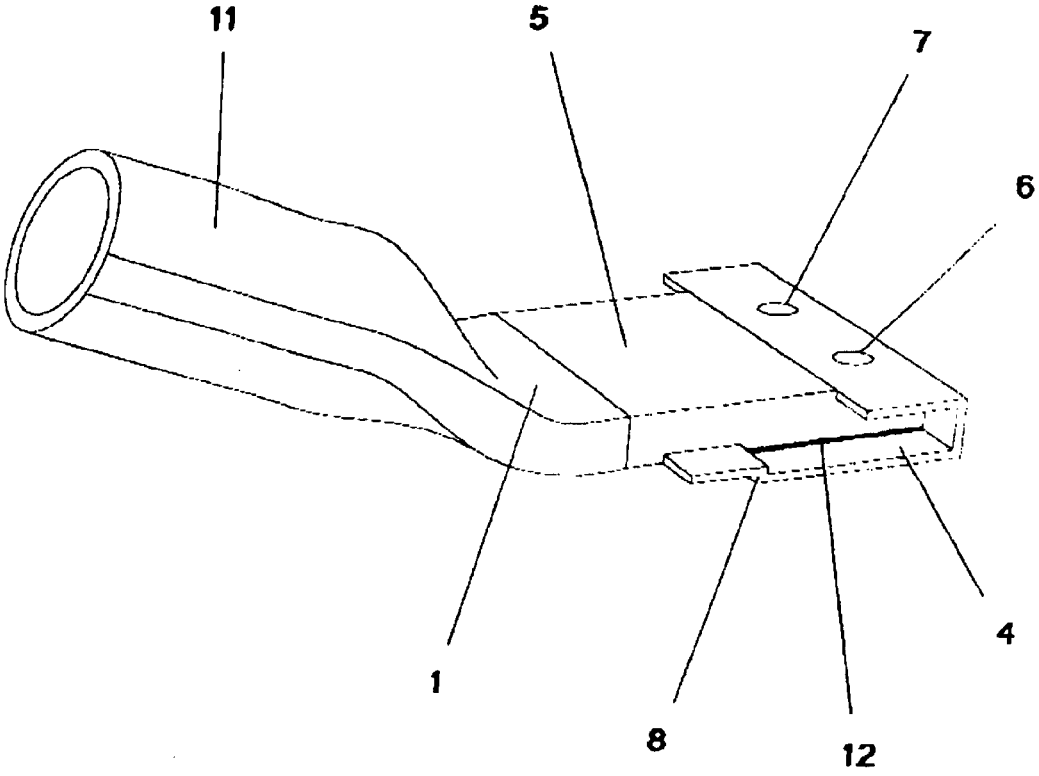
FIG. 3 shows a connecting piece in the form of a cable shoe.

FIG. 3 shows a variant of a connecting piece 1 of electrically conducting material, preferably a cable shoe, with a tube part 11 of greater length into which is introduced a connecting member of electrically conducting material. The figure also shows the compact plate 5 of electrically conducting material which, in a completely new brazing process according to the invention, forms the unit on which acts the electric arc from the carbon electrode in a brazing gun. In the brazing process a carbon electrode is employed in which the carbon powder that is released from the carbon electrode is deposited as a thin layer on the compact plate 5 of the underlying connecting piece 1 and acts as a temperature buffer and heat distributor.

The overall result of the above arrangement is a brazing that is free from structural changes or martensite. Furthermore the electric arc is maintained between two carbon poles, which has a stabilising effect on the arc and counteracts the tendency of the current to vary over time.

The connecting piece 1 has at least one compact plate end 5 of electrically conducting material. The underneath side of the connecting piece 1 has a clip 4 of brazing material that is secured for example by pressing it on during fabrication. The brazing process produces a brazed joint of larger area, which in turn produces a lower overall electrical contact resistance. A flux material 12 is located between the connecting piece 1 and brazing clip 4 and a flux material is also located between the brazing clip 4 and a workpiece, the flux material, brazing material and brazing process being suitably adapted to one another. The flux material 12 is suitable for soft brazing and is therefore active in a low temperature range, resulting in a martensite-free brazing.

A brazing that is carried out above ca. 500° C. is termed hard brazing, in contrast to soft brazing, which takes place at lower temperatures. The brazing material and brazing clip 4 that are employed in the brazing process are suitable for hard brazing. Flux material that is suitable for hard brazing does not perform well in the new process since the latter takes place extremely quickly, in about two seconds. In the new brazing process a flux material is used that is suitable for soft brazing and is consequently activated at a lower temperature, but does not disintegrate before the brazing is completed, due to the short duration of the procedure. The figure also shows holes 6 and 7 for securing the brazing clip 4 and connecting piece 1, as well as the bevelled section 8.

Figure 4:
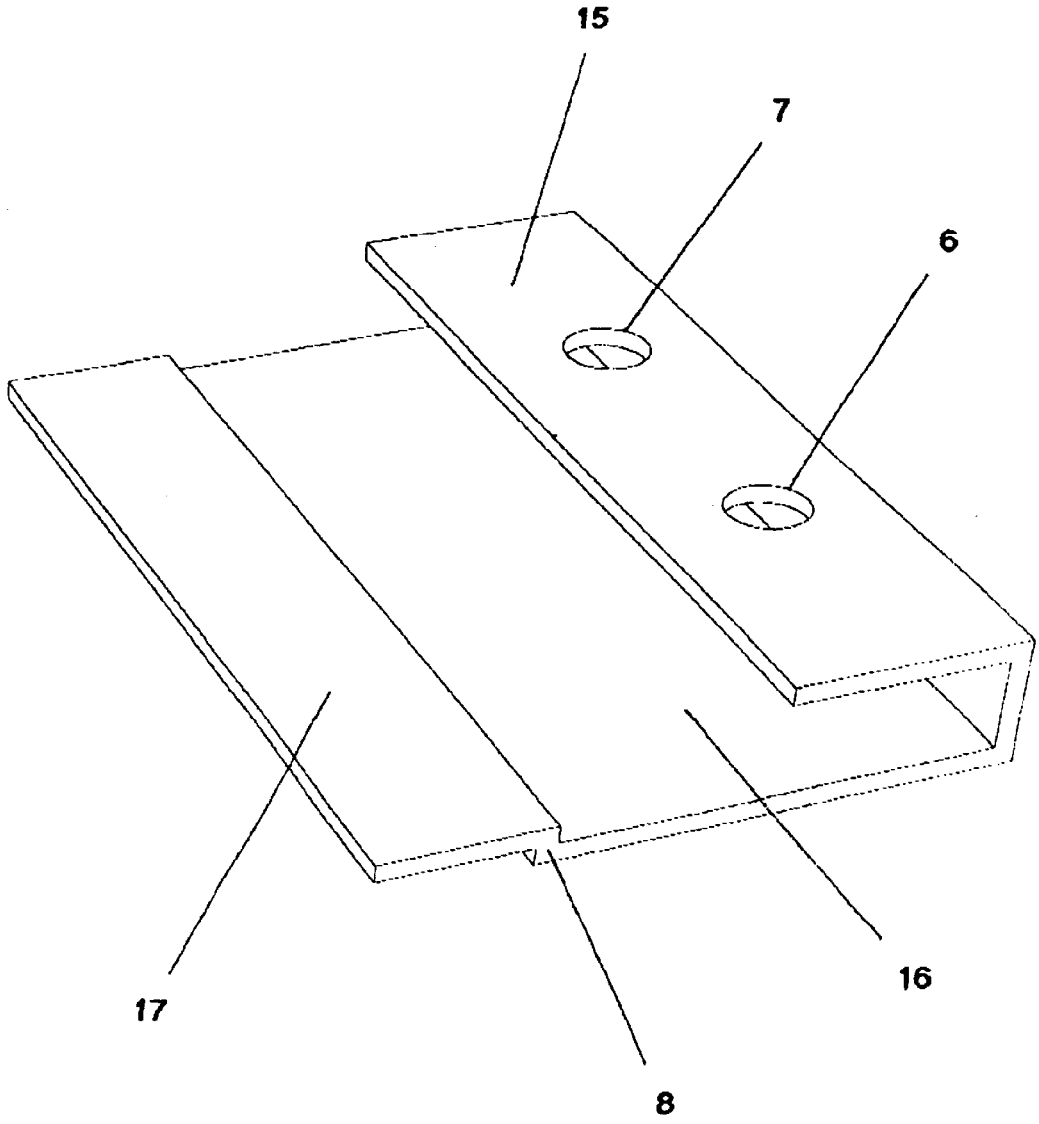
FIG. 4 shows a separate brazing clip after the latter has been pressed onto the connecting piece.

FIG. 4 shows a separate brazing clip after it has been pressed on the connecting piece. The figure shows holes 6 and 7 on the upper side of the upper part 15 of the brazing clip 4. The figure also shows the lower part 16 on which is placed a flux material 12 that is incorporated between the connecting piece 1 and brazing clip 4. Behind a bevelled section 8 is a rear part 17 of the brazing clip 4 that is pressed into the connecting piece 1.

Figure 5:
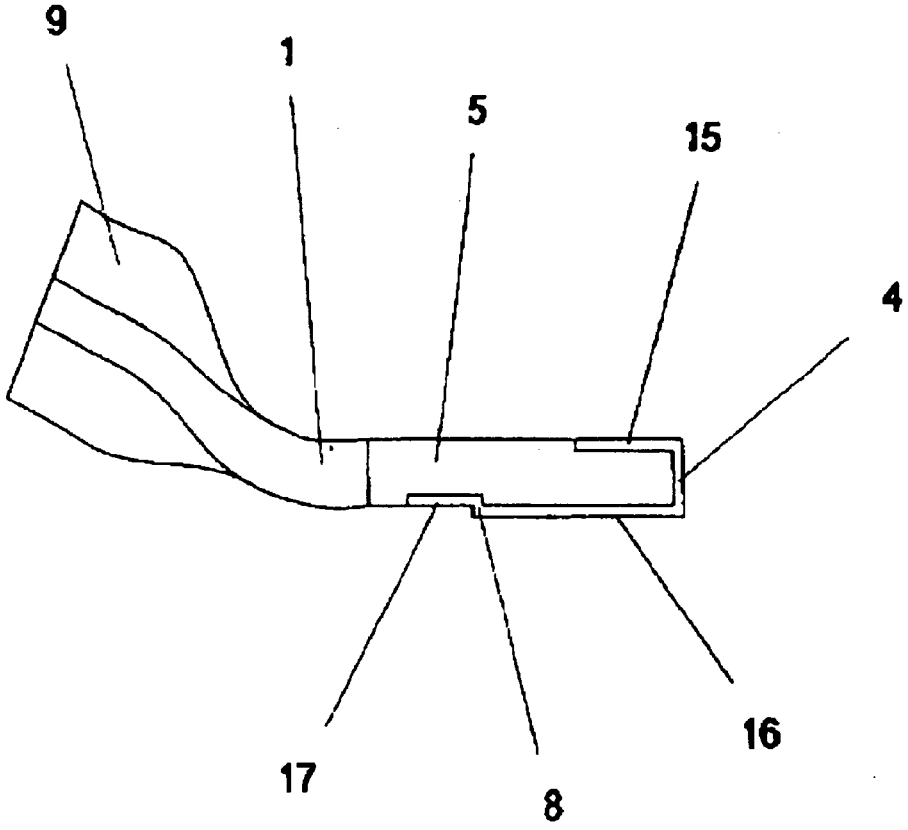
FIG. 5 is a side view of a finished connecting piece.

FIG. 5 is a side view of a connecting piece 1 of electrically conducting material with a tube part 9 and a compact plate 5 onto which a brazing clip 4 is pressed, and there can also be seen the upper part 15, lower part 16 and rear part 17 of the brazing clip 4, as well as the bevelled section 8. It can be seen from the figure that the brazing clip 4 has a uniform thickness.

Figure 6:
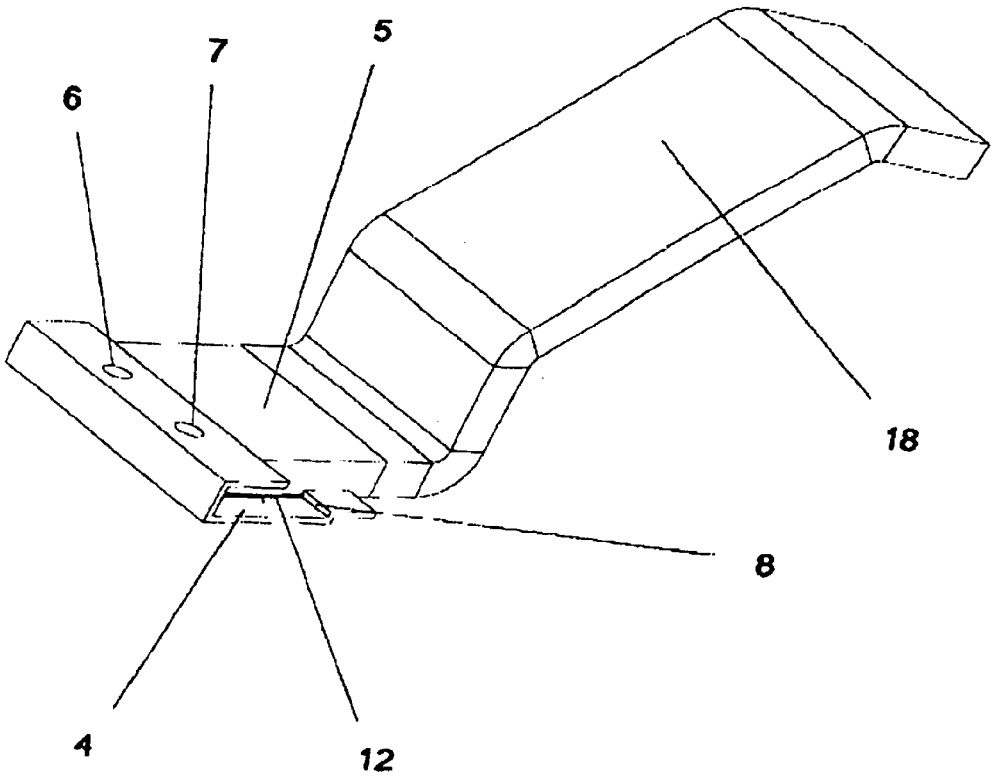
FIG. 6 shows a connecting piece of brazable material of a different design.

FIG. 6 shows a connecting piece in the shape of a bracket of brazable material. In the figure there can be seen the compact plate 5 and also the flux material 12 that is incorporated between the compact plate 5 and brazing clip 4. Holes 6 and 7 for securement purposes and the bevelled section 8 can also be seen.

Figure 7:
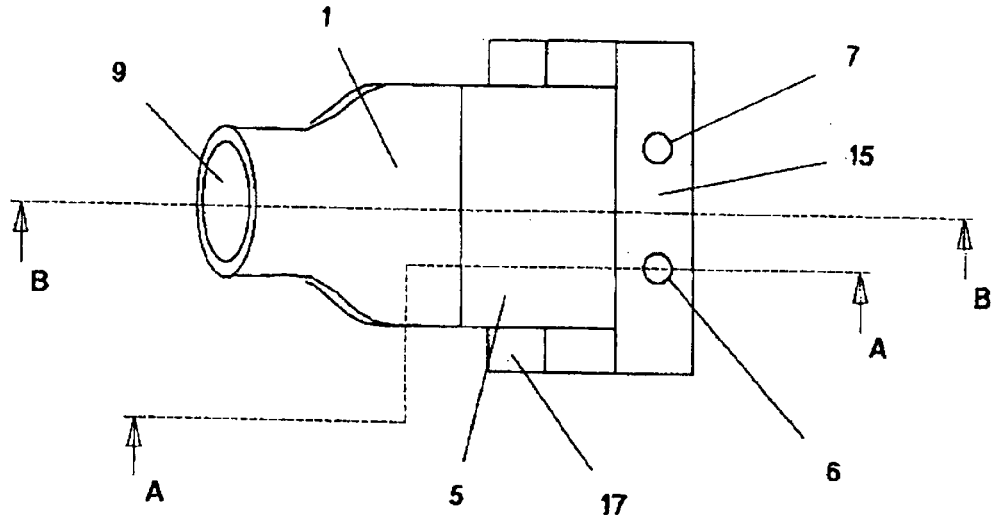
FIG. 7 shows the connecting piece/cable shoe of FIG. 1.

The connecting piece 1 in the form of a cable shoe is shown from above in FIG. 7. The figure shows the tube part 9 and brazing clip 4. It can also be seen from the figure that the brazing clip 4 is fashioned so that it is larger than the connecting piece 1 per se and its compact plate 5 projects from the edges. This creates a more secure and more complete assembly of the cable shoe and workpiece, and prevents water from penetrating by means of capillary forces between the cable shoe and the underlying workpiece, and in addition prevents corrosion. Penetrating water may adversely affect the mechanical strength of the brazed joint. In addition this can impair the electrical properties of the connection. Since the brazing clip is larger than the cable shoe a larger joint surface is created, which in turn leads to a lower electrical contact resistance. The figure also shows the rear part 17 and upper part 15 of the brazing clip 4 together with holes 6 and 7.

Figure 8:
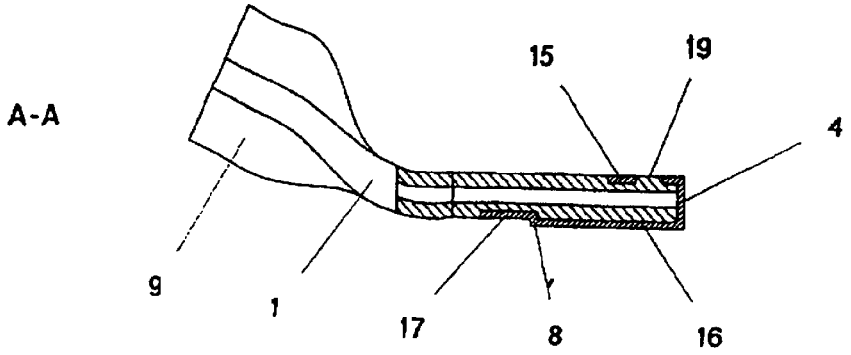
FIG. 8 shows a sectional view taken along the section A-A of FIG. 7.

FIG. 8 is a section A-A of the above figure. This section shows penetrating material 19 in the hole in the brazing clip 4, together with its upper part 15, lower part 16 and rear part 17 as well as the bevelled section 8 and tube part 9 in the connecting piece 1.

Figure 9:
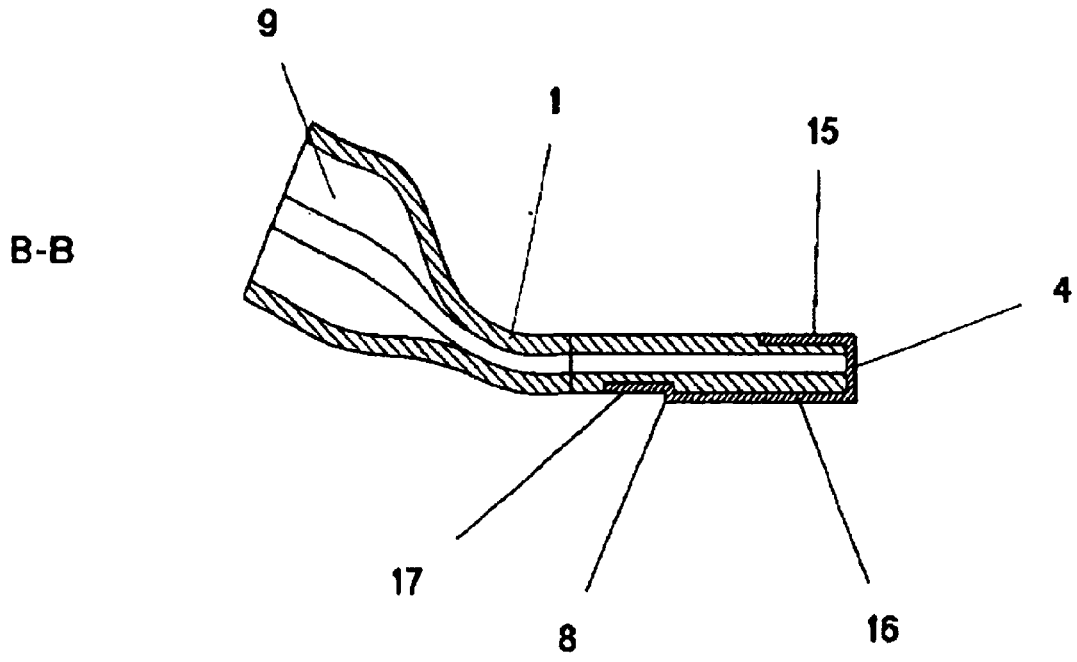
FIG. 9 shows a sectional view taken along the section B-B of FIG. 7.

FIG. 9 shows a section B-B of FIG. 7. The section shows the brazing clip 4 with its upper part 15, lower part 16 and rear part 17 as well as bevelled section 8, tube part 9 and connecting piece 1.

Figure 10:
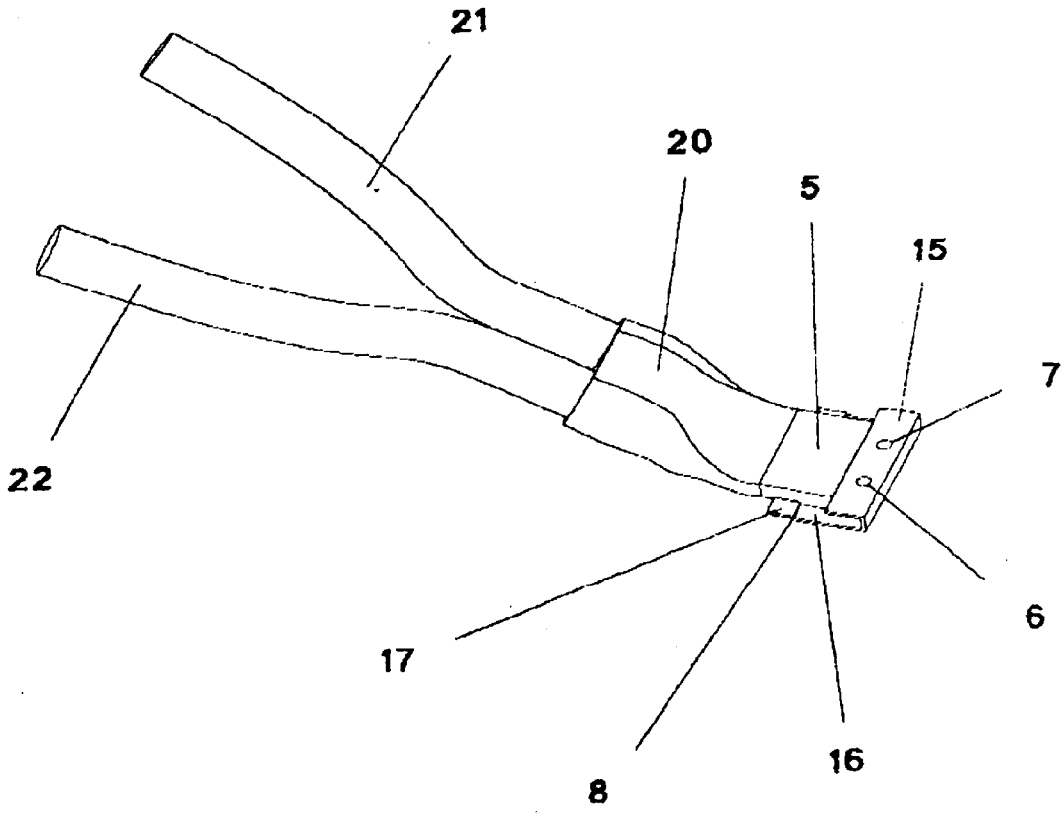
FIG. 10 illustrates the connecting piece of electrically conducting material by means of which two cables of electrically conducting material are joined together.
Figure 11:
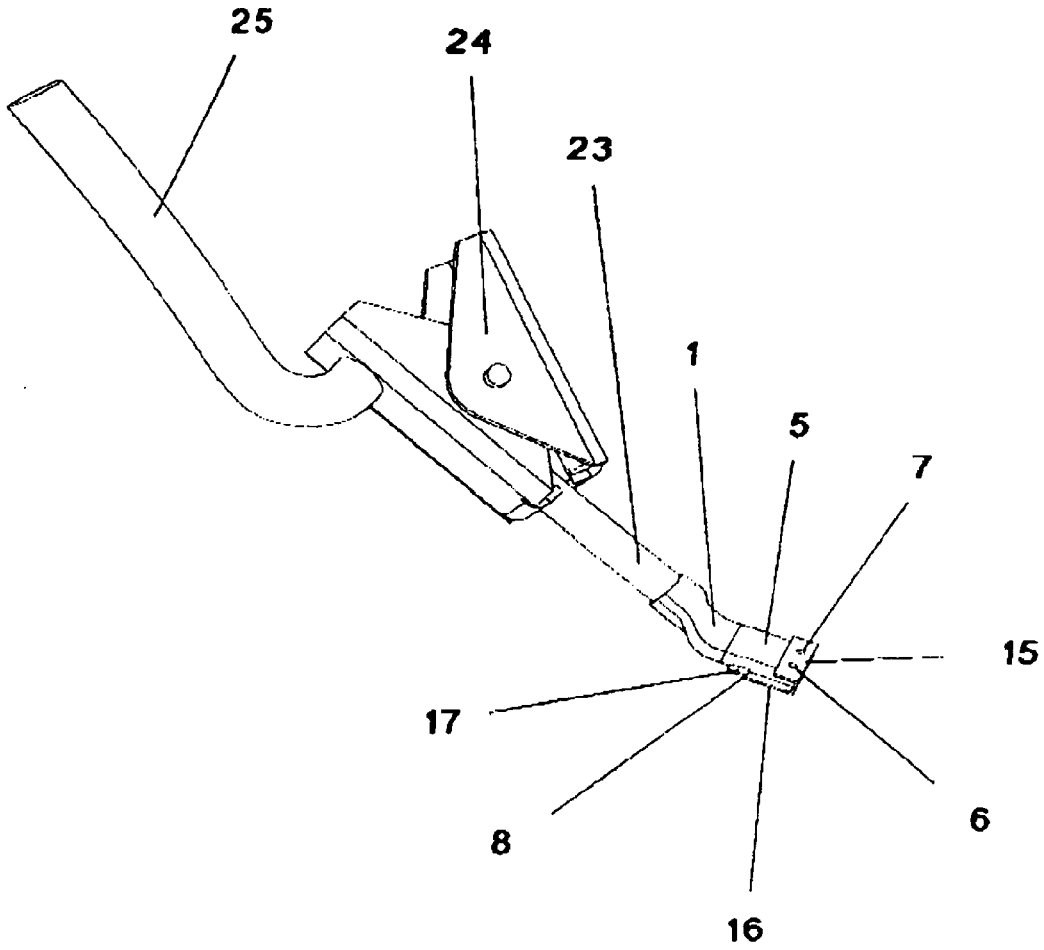
FIG. 11 shows the connecting piece plus cable with a coupled grounding contact.

FIG. 10 illustrates the connecting piece of electrically conducting material, a so-called Y-shaped connecting piece, by means of which two cables of electrically conducting material are joined together. The figure shows the compact plate 5 together with the rear part 17, lower part 16 and upper part 15 of the brazing clip 4 and holes 6 and 7. Two other cables 21 and 22 of electrically conducting material form part of a multiple connecting piece 20 to which they are firmly brazed. The interior of the multiple connecting piece 20 is filled with a paste of flux material and brazing material before the brazing stage.

FIG. 7 shows the connecting piece 1 together with a cable 23 with a coupled connecting clamp 24 and associated connection cable 25 constituting a grounding contact. The figure also shows the compact plate 5 together with the rear part 17, lower part 16 and upper part 15 of the brazing clip 4, and holes 6 and 7. Finally, the bevelled section 8 can also be seen.

In the new brazing process the electrode forms one pole or terminal of the arc and the other pole is formed by the connecting piece, for example a cable shoe. It is advantageous that the rail itself is not used as a pole since this can produce secondary arcs between the cable shoe and rail that can have deleterious effects on the latter in the form of martensite formation. Furthermore, by excluding the rail from the closed electrical circuit the occurrence of possible interference signals in the rail and apparatus connected thereto is eliminated. By using the cable shoe as one pole a workstage, and in certain situations grounding equipment and brazing associated therewith, are also eliminated. The cable shoe 1 may be connected to the electrical circuit via the cable 23 connected to the said cable shoe 1.

Figure 12:
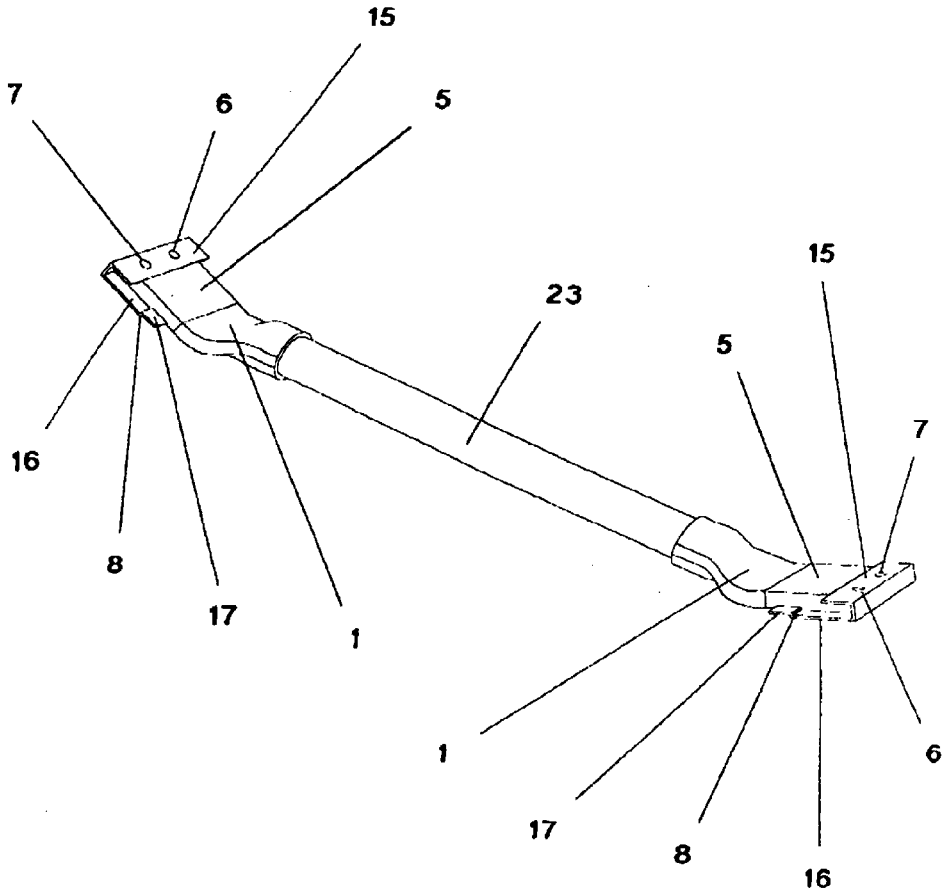
FIG. 12 is a view of a contact connection in which both ends are provided with a connecting piece in the form of a cable shoe.

FIG. 12 is a view of a contact connection in which both ends are provided with connection pieces 1 in the form of cable shoes. The figure shows a cable 23 of electrically conducting material between two connecting pieces 1 in which each connecting piece 1 has a compact plate 5, and the brazing clip 4 comprises a rear part 17, lower part 16 and upper part 15 and holes 6 and 7 together with a bevelled section 8.

Figure 13:
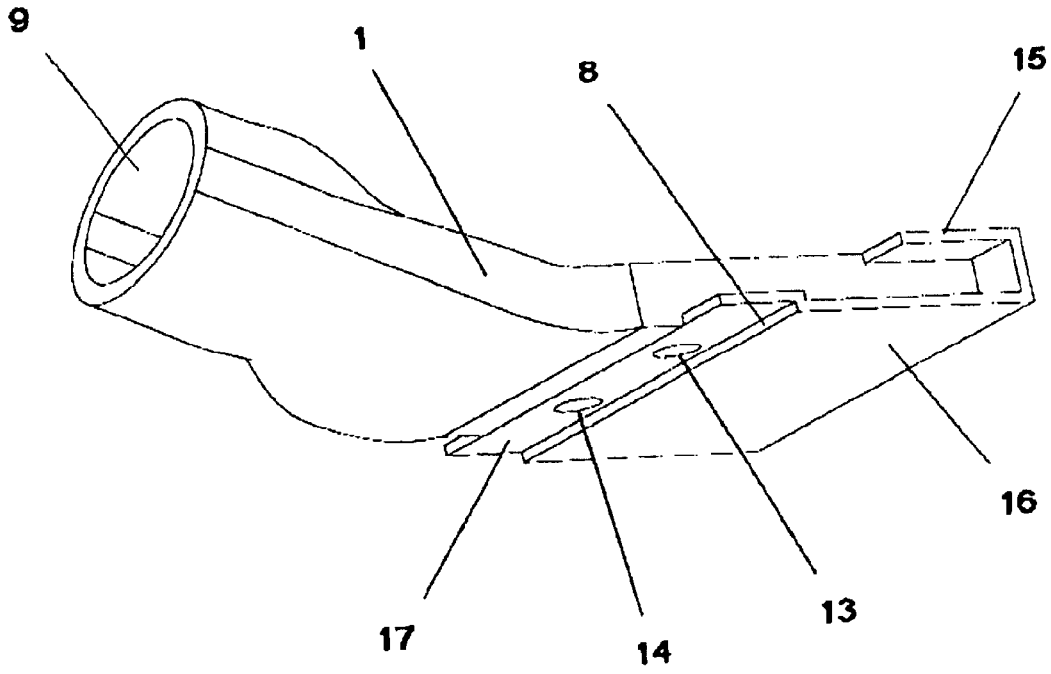
FIGS. 13 and 14 show a variant of the securement of the brazing clip to the connecting piece, in which the brazing clip per se of this variant can be seen.

FIG. 13 is a view from below of the attachment of the brazing clip 4, with its parts 15, 16 and 17, to the connecting piece 1. Two holes 13 and 14 for penetrating material from the connecting piece 1 can be seen on the rear part 17 of the brazing clip 4. A tube part 4 can also be seen in the figure.

Figure 14:
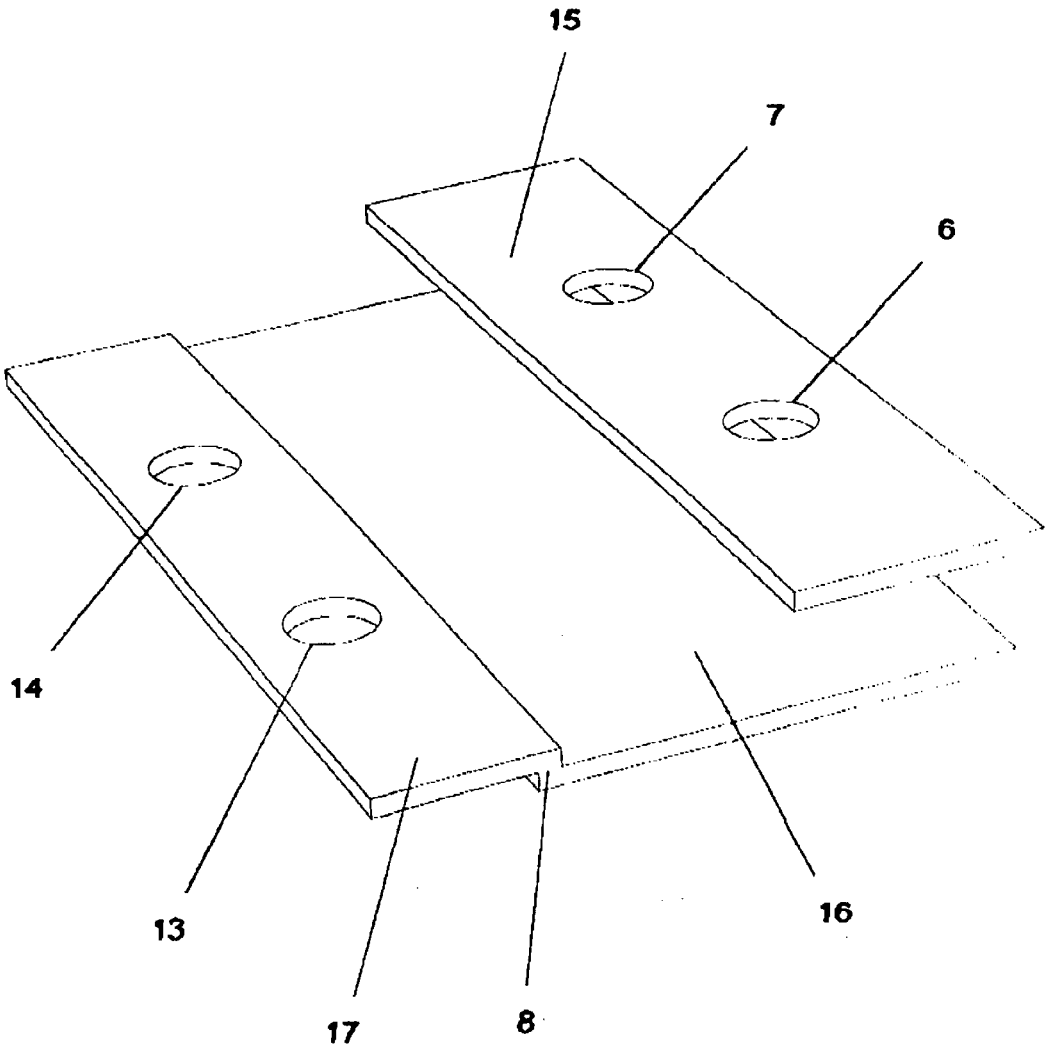

FIG. 14 shows the brazing clip 4 per se of the preceding figure, in which can be seen holes 6 and 7 on the upper part 15 of the brazing clip and holes 13 and 14 on the rear part 17 of the brazing clip, in which material from the connecting piece 1 is forced out by pressing together the brazing clip and the connecting piece. The bevelled section 8 and lower part 16 of the brazing clip can also be seen.

Figure 15:
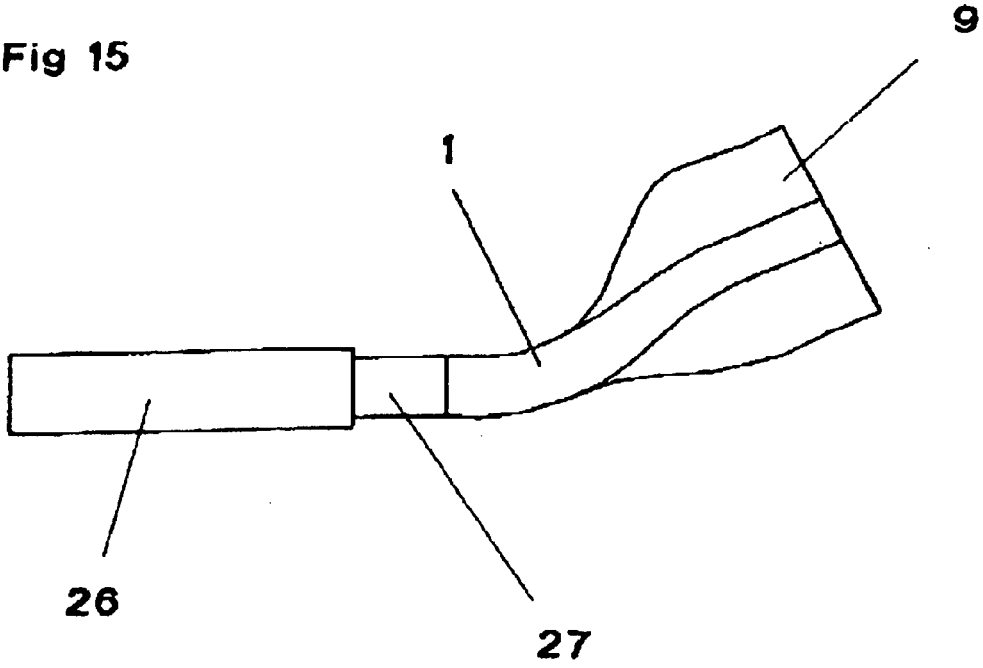
FIG. 15 shows a further variant of a brazing clip mounted on a cable shoe.

FIG. 15 is a further variant of a brazing clip secured to a cable shoe 1 with a tube section 9 and in which can be seen the pressed-on brazing clip 26 and an inwardly tapering compact plate 27.

Figure 16:
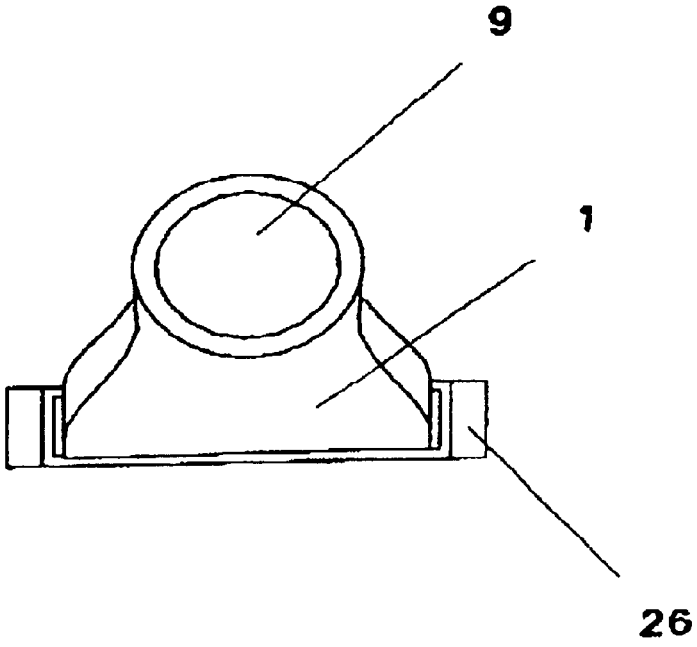
FIG. 16 shows the cable shoe itself plus brazing clip from the rear.

FIG. 16 is a rear view of the cable shoe per se together with the brazing clip 26. The tube section 9 is also shown from the rear.

Figure 17:
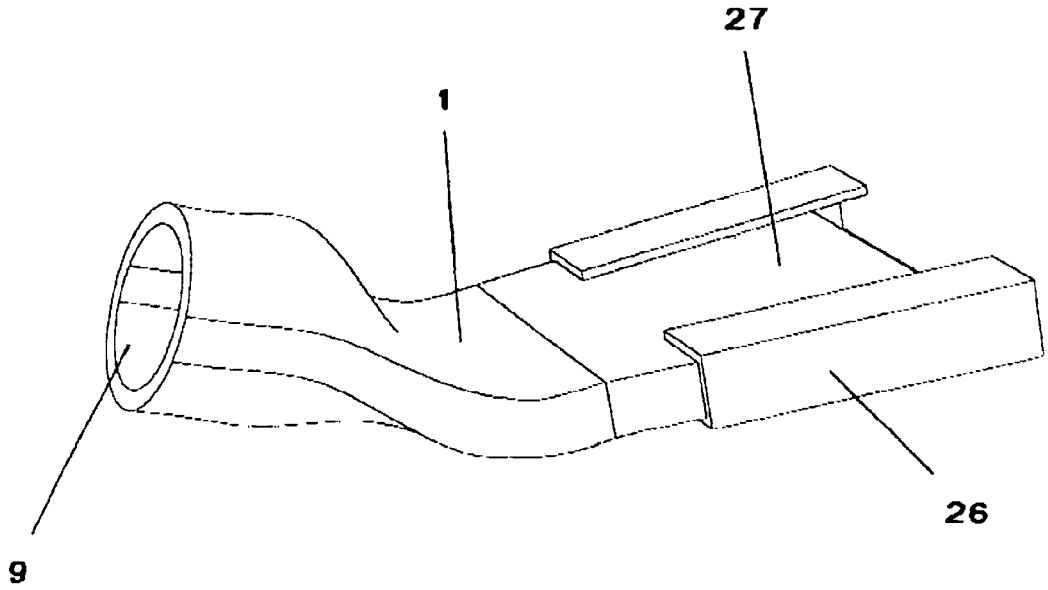
FIG. 17 is a view of the cable shoe itself seen obliquely from above.

FIG. 17 is a view from above of the cable shoe 1 per se with a tube section 9. It can be seen from the figure that the brazing clip 26 is shaped so that it can be fitted onto the compact tapering plate 27.

Figure 18:
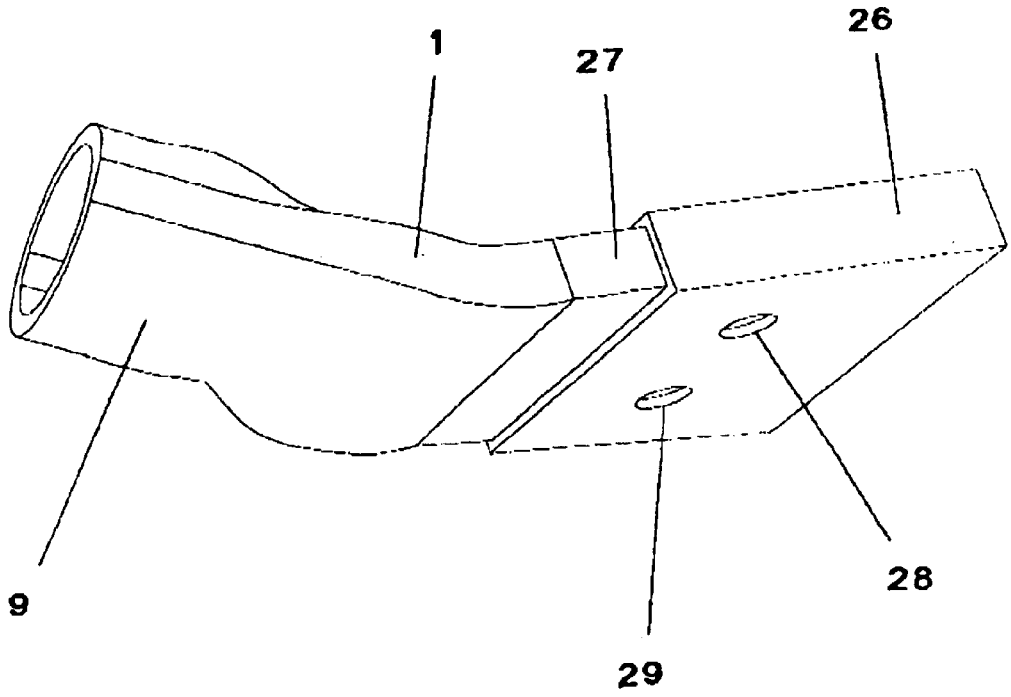
FIG. 18 is a view from below of the variant of FIG. 17.

FIG. 18 is a view from below of the above variant of connecting piece with the brazing clip 26, which is located on the compact plate 27. Two holes 28 and 29 are provided on the underneath of the brazing clip 26 that permit flux material to penetrate from the underlying workpiece. In this variant of connecting piece with brazing clip, no flux material is incorporated between the latter. Consequently it is the flux material from the workpiece that penetrates upwardly and acts inside the brazing clip 26, melting the brazing material.

Figure 19:
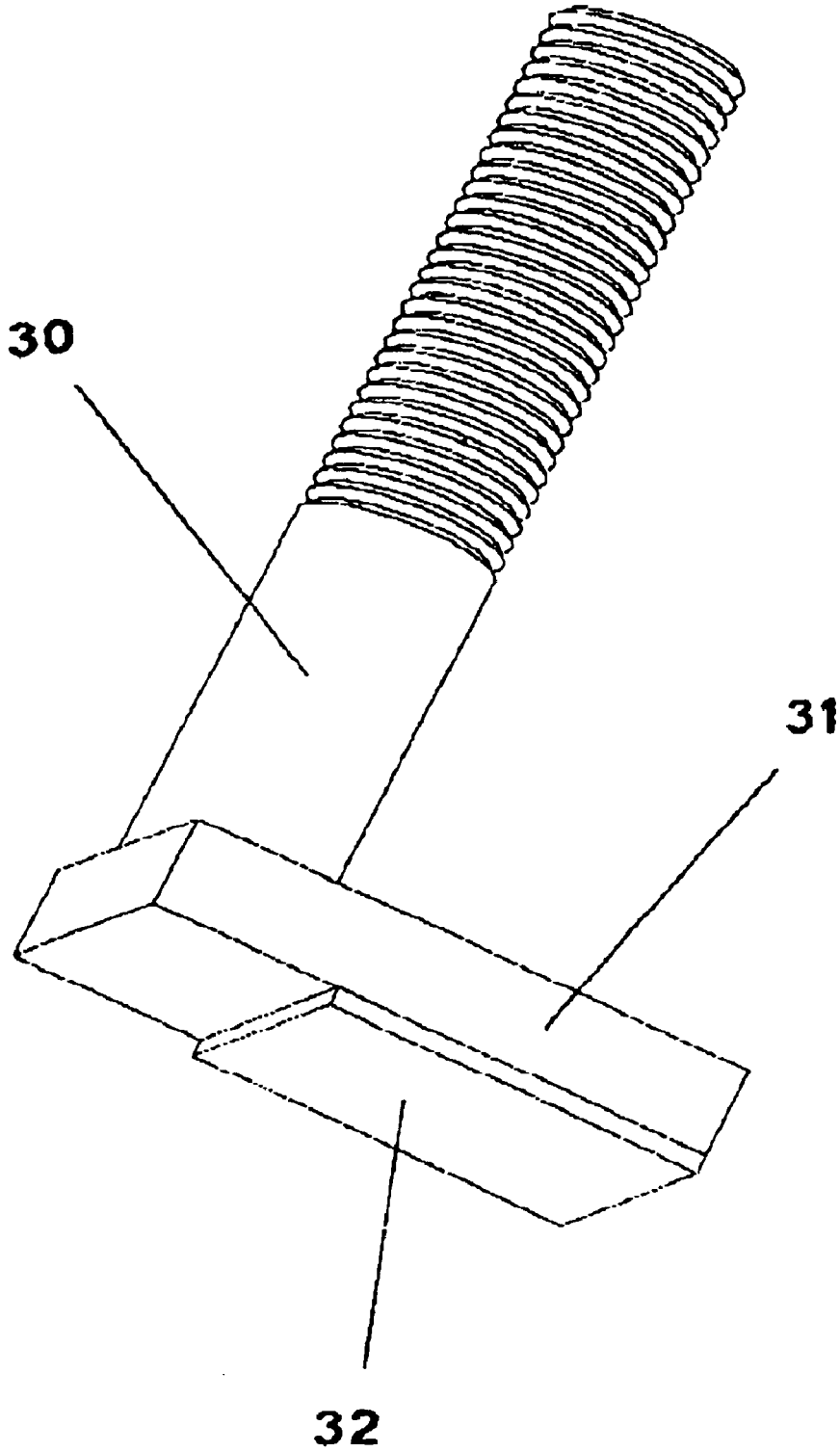
FIG. 19 shows a connecting piece of electrically conducting material with a bolt.

FIG. 19 shows a bolt-type connecting piece of electrically conducting material. The compact plate 31 that forms a single brazing joint as well as the underlying brazing plate 32 that may be fused thereon or may also be shaped as a clip can be seen in the figure. Finally, a bolt 30 is also shown.

Figure 20:
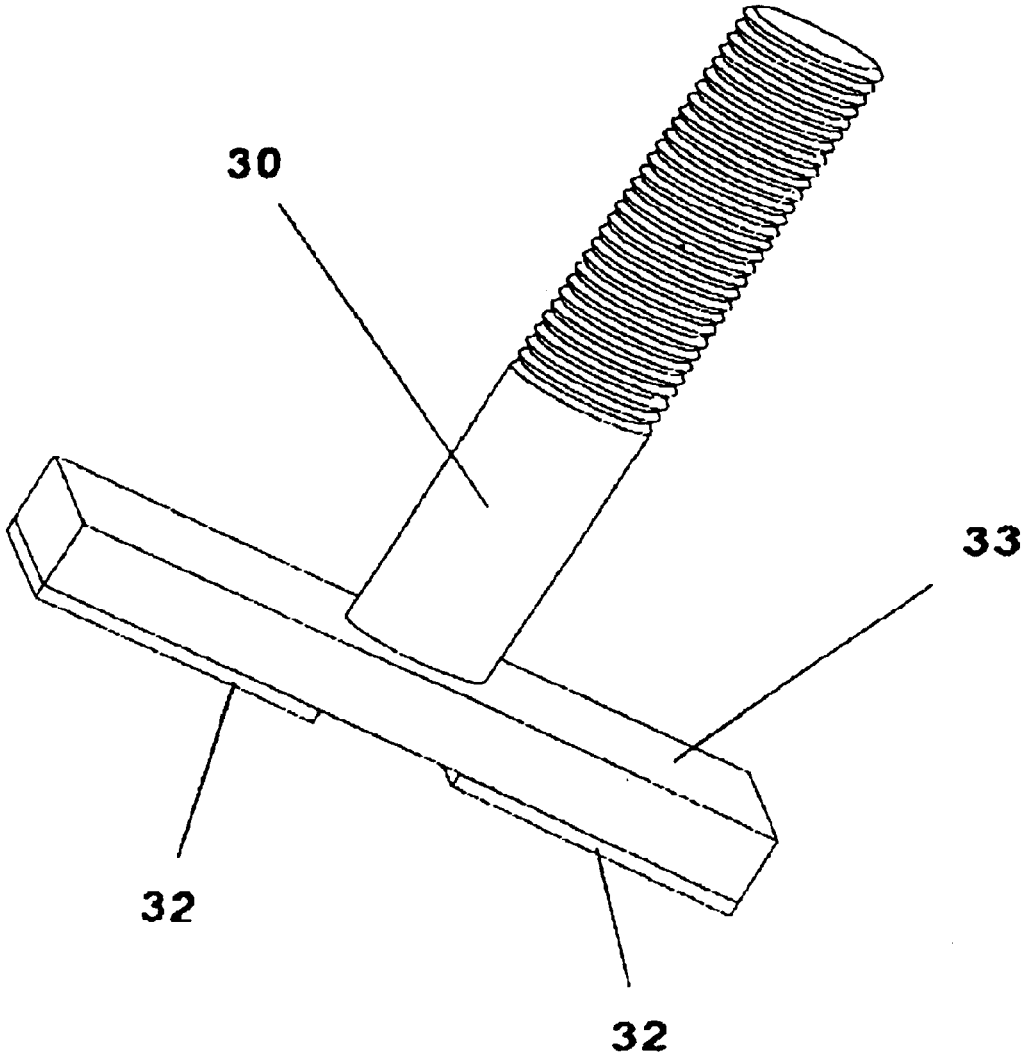
FIG. 20 shows a variant of a connecting piece with a bolt.

FIG. 20 shows a bolt-type connecting piece with a double brazing joint, and there can be seen the bolt 30 in the middle of the compact plate 33 and two brazing plates 32 fused onto the underneath of the latter, which may also be shaped as clips.

Figure 21:
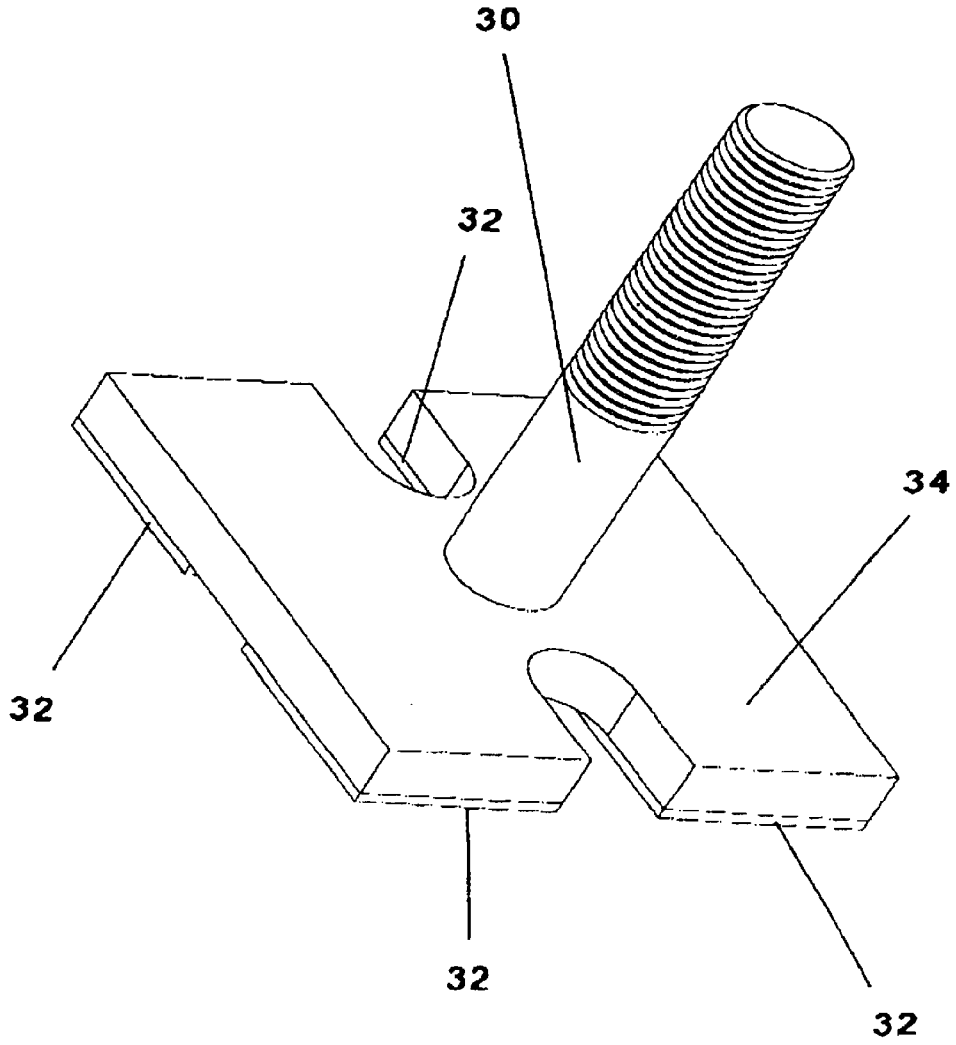
FIG. 21 shows yet a further variant of a connecting piece with a bolt.

FIG. 21 is yet a further variant of a connecting piece with a bolt forming a so-called bolt-type connecting piece. The figure shows a bolt 30 centered on the connecting piece 34. The figure also shows four brazing plates 32 that are either fused on or may be shaped as clips.

Figure 22:
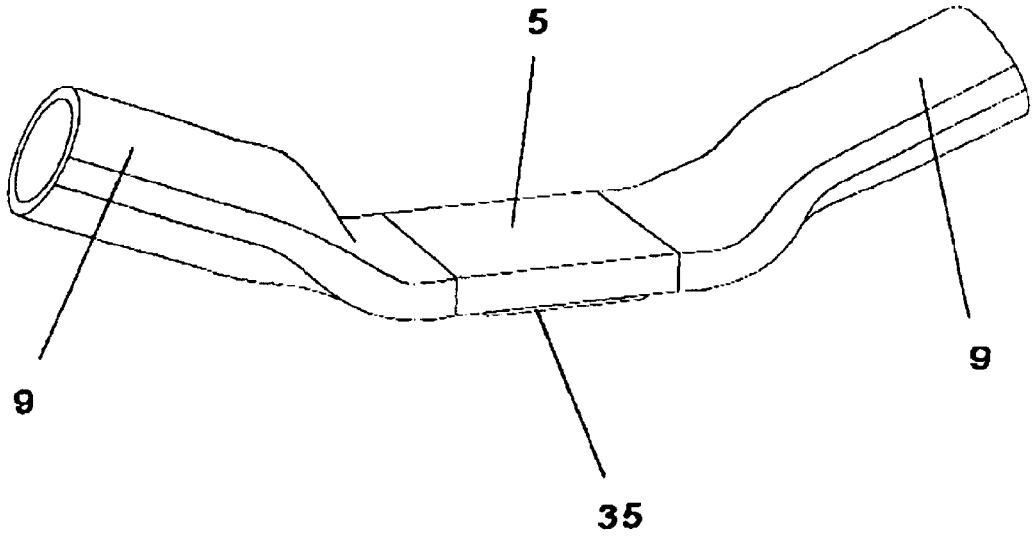
FIG. 22 shows an intermediate coupling piece.

FIG. 22 is an intermediate coupling piece that shows a flat continuous compact plate 5 with a brazing material 35 fused on underneath the plate, the brazing material which may also be shaped as a clip; the figure also shows two tube parts 9.

The object of the present invention is to produce a connecting piece of electrically conducting material, preferably a cable shoe, consisting of a compact plate of electrically conducting material with a brazing clip of uniform thickness pressed or forced thereon, a flux material being incorporated between the latter so that the connecting piece is capable of being used in a new type of temperature-controlled brazing process, and in which the flux material, brazing material and brazing process mutually co-operate. The brazing clip is larger than the compact plate and projects around its edges, which prevents penetration of water and also forms a larger joint surface that in turn produces a lower electrical contact resistance. The compact plate prevents the electric arc generated in the process acting directly on the workpiece and also avoids grounding the electrical circuit via the cable of the connecting piece, thereby preventing secondary arcs between the connecting piece and workpiece, for example a rail. The compact plate also collects the carbon powder that is released from the carbon electrode during the brazing process, which prevents the formation of a cavity in the cable shoe and has a stabilising effect on the arc. The overall result is that a brazing is produced that is free from martensite underneath the brazed joint.

Only some embodiments of the present invention have been illustrated in the drawings, but it should be pointed out that many other modifications are conceivable within the scope of the following claims.

What is claimed is:

1. Method for producing a new type of connecting piece of electrically conducting material that is to be joined to another object of electrically conducting material by means of a temperature-controlled brazing process free from structural changes and martensite formation, comprising: pressing a tube of electrically conducting material and a brazing material suitable for hard brazing with an intermediate flux material suitable for soft brazing between an upper part of a tool and a lower part of the tool so as to form a connecting piece with a brazing clip pressed thereon and an intermediately located flux material, said clip including an upper part with two holes, a lower part and a rear part with two holes, said brazing clip being larger than a compact plate in one part of the connecting piece and being of uniform thickness, with a bevelled section separating the lower part of the brazing clip from said rear part thereof.

2. A connecting piece of electrically conducting material that is to be joined to a workpiece of electrically conducting material by means of a temperature-controlled brazing process free from structural changes and martensite formation, comprising: at least one flat compact continuous plate of electrically conducting material that collects carbon powder from a carbon electrode, an electric arc generated in the brazing process acting on the compact plate; and brazing clip of uniform thickness pressed onto the connecting piece with a flux material incorporated therebetween, said brazing clip being larger than the compact plate and having four holes that permit the brazing clip to be pressed onto the connecting piece.

3. The connecting piece according to claim 2, wherein the brazing clip is pressed onto the compact plate of the connecting piece.

4. The connecting piece according to claim 2, wherein a connecting clamp is connected to a connecting cable of the connecting piece for grounding.

5. The connecting piece according to claim 2, wherein the brazing clip has two additional holes on an underside thereof to allow penetration of flux material.

6. The connecting piece according to claim 2, wherein a bolt is provided on a further compact plate and brazing material is fused on said further compact plate.

* * * * *